US005553692A

United States Patent [19]

Sheiman

[11] Patent Number: 5,553,692

[45] Date of Patent: Sep. 10, 1996

[54] MOBILE CARRYING CASE

[75] Inventor: Samuel R. Sheiman, Rockville Center, N.Y.

[73] Assignee: Crest Lock Co., Inc., Brooklyn, N.Y.

[21] Appl. No.: 373,067

[22] Filed: Jan. 17, 1995

[51] Int. Cl.[6] ..... A45C 5/14; A45C 13/26

[52] U.S. Cl. ..... 190/18 A; 190/39; 190/115; 16/115; 280/37; 280/655

[58] Field of Search ..... 190/18 A, 39, 190/115; 16/115; 280/37, 655, 655.1, 47.315

[56] References Cited

U.S. PATENT DOCUMENTS

| | | | |
|---|---|---|---|
| 381,646 | 4/1888 | Rivers | 190/39 |
| 4,154,545 | 5/1979 | Pinto et al. | 16/115 X |
| 4,358,006 | 11/1982 | Castelli | 190/18 A |
| 4,838,396 | 6/1989 | Krenzel | 190/18 A |
| 5,075,925 | 12/1991 | Maloney | 190/18 A X |
| 5,108,119 | 4/1992 | Huang | 190/18 A X |
| 5,116,289 | 5/1992 | Pond et al. | 190/115 X |
| 5,165,508 | 11/1992 | Kim | 190/115 |
| 5,330,037 | 7/1994 | Wang | 190/18 A |
| 5,339,934 | 8/1994 | Liang | 190/18 A |
| 5,435,423 | 7/1995 | Rekuc et al. | 190/115 X |

*Primary Examiner*—Sue A. Weaver
*Attorney, Agent, or Firm*—Kirschstein, et al.

[57] ABSTRACT

A steering handle assembly is exteriorly mounted on an end wall of a mobile carrying case. The assembly is movable among a stowed position and a plurality of steering positions, and a steering handle is extendible and retractable to a desired elevation. The case can either be carried by hand or rolled along the ground.

8 Claims, 2 Drawing Sheets

FIG. 4
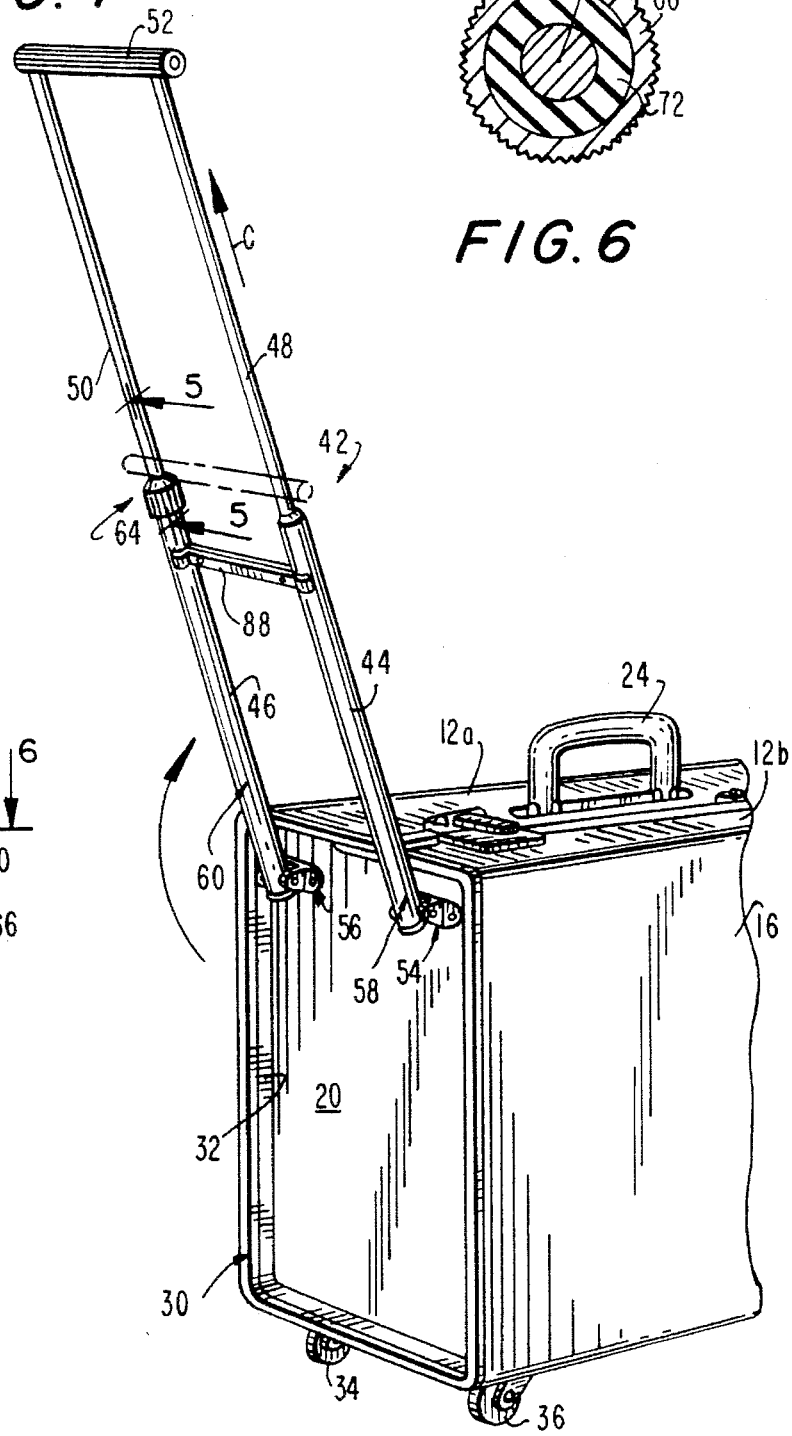
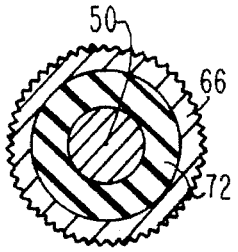
FIG. 6
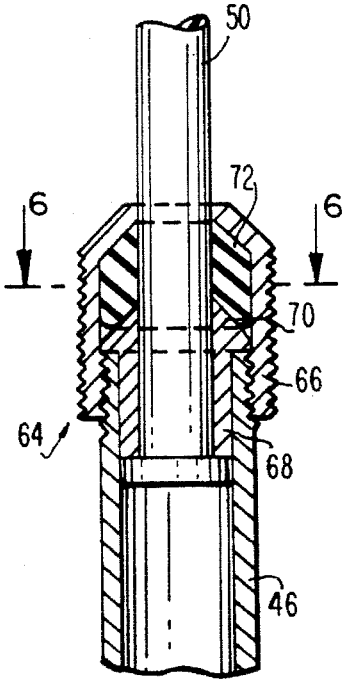
FIG. 5

MOBILE CARRYING CASE

BACKGROUND OF THE INVENTION

1. Field of the Invention

This invention generally relates to a carrying case that can either be manually carried or wheeled across the ground.

2. Description of the Related Art

Portable carrying cases that can either be manually carried or wheeled across the ground with the aid of an extensible/retractable handle assembly are known in the art. The handle assembly can be mounted inside the case, for example, see U.S. Pat. No. 4,036,336, or outside the case on a frame, for example, see U.S. Pat. Nos. 5,108,119 5,165,508 and 5,116,289 are also representative of this art.

The need persists, however, to provide a mobile carrying case with a handle assembly structurally strong enough to wheel around heavy loads, but yet light enough in weight so as to readily enable light loads to be manually carried. The handle assembly should not unduly impinge upon the interior of the case to maximize the load-carrying capacity thereof, but yet be unobtrusive at the exterior of the case so as to present an attractive appearance.

SUMMARY OF THE INVENTION

Objects of the Invention

It is a general object of this invention to provide a mobile carrying case that can readily be manually carried and, at the option of a user, be wheeled along the ground.

Another object of this invention is to provide such a case with an extendible/retractable handle assembly that is lightweight, yet structurally strong enough to pull, push or otherwise steer heavy loads along the ground.

Yet another object of this invention is to provide such a handle assembly with an attractive, unobtrusive appearance.

An additional object of this invention is to readily convert a conventional carrying case into a mobile case capable of being wheeled around without sacrificing the load-carrying capability thereof.

Features of the Invention

In keeping with these objects and others which will become apparent hereinafter, one feature of this invention resides, briefly stated, in a mobile carrying case, which comprises a container including top, bottom and side walls having peripheral end flanges, and end walls bounding end cavities with the peripheral end flanges. All of the container walls bound an interior. A carrying handle is mounted on the top wall. A plurality of wheels is mounted on the bottom wall.

In accordance with this invention, a steering handle assembly is exteriorly mounted on one of the end walls for movement between a stowed position in which the assembly is fully contained within one of the end cavities, and a plurality of steering positions in each of which the assembly extends outwardly of said one end cavity.

In the preferred embodiment, the bottom wall has four corner regions, and there are four wheels, one at each corner region. Two of the wheels at the corner regions adjacent the handle assembly are mounted on the bottom wall for swiveling movement. The other two of the wheels are mounted at the remaining corner regions remote from the assembly for rolling movement about a fixed axis.

The steering handle assembly includes a pair of elongated storage tubes mounted on said one end wall for pivoting movement among said positions, a pair of elongated rods mounted for telescoping movement along the tubes, and a steering handle connected to the rods for joint movement therewith. In use, the rods are slidable along the tubes in order to variably position the steering handle relative to said one end wall. Locking means are provided for adjustably locking the steering handle at a selected distance from said one end wall. The locking means advantageously includes a manually turnable element on one of the storage tubes for lockingly engaging the rod mounted therewithin.

In accordance with another feature of this invention, means are provided for holding the assembly in each of said positions. Thus, a spring is mounted between at least one of the tubes and said one end wall. The tube itself has three exterior abutment surfaces. The spring engages one of the abutment surfaces in the stowed position, another of the abutment surfaces in a first steering position in which the tube extends at a generally right angle relative to said one end wall, and still another abutment surface in a second steering position in which the tube extends at an obtuse angle relative to said one end wall. The spring thus serves to reliably hold the assembly in each of said positions.

The tubes, rods and handle are advantageously constituted of a light metal, e.g., aluminum, which readily permits the case to be manually carried, and yet, it is sturdy enough to enable a user to pull, push or otherwise steer heavy loads. The tubes, rods and handle are all mounted exteriorly of the case, both in the extended and retracted positions of the rods, thereby not impinging on the interior volume of the case and not sacrificing any load-carrying capacity thereof. In the stowed position of the handle assembly, the assembly is fully contained within one of the end cavities, thereby being unobtrusive and presenting an attractive outer appearance for the case. The handle assembly may be readily attached to a conventional carrying case in order to convert the same into a mobile case as described above.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is a broken-away, perspective view of the case of FIG. 1, showing the handle assembly in one of its steering positions, and also showing the handle assembly in an extended position;

FIG. 5 is an enlarged, sectional view taken on line 5—5 of FIG. 4; and FIG. 6 is a sectional taken on line 6—6 of FIG. 5.

DETAILED DESCRIPTION OF THE PREFERRED EMBODIMENT

Figure 1:
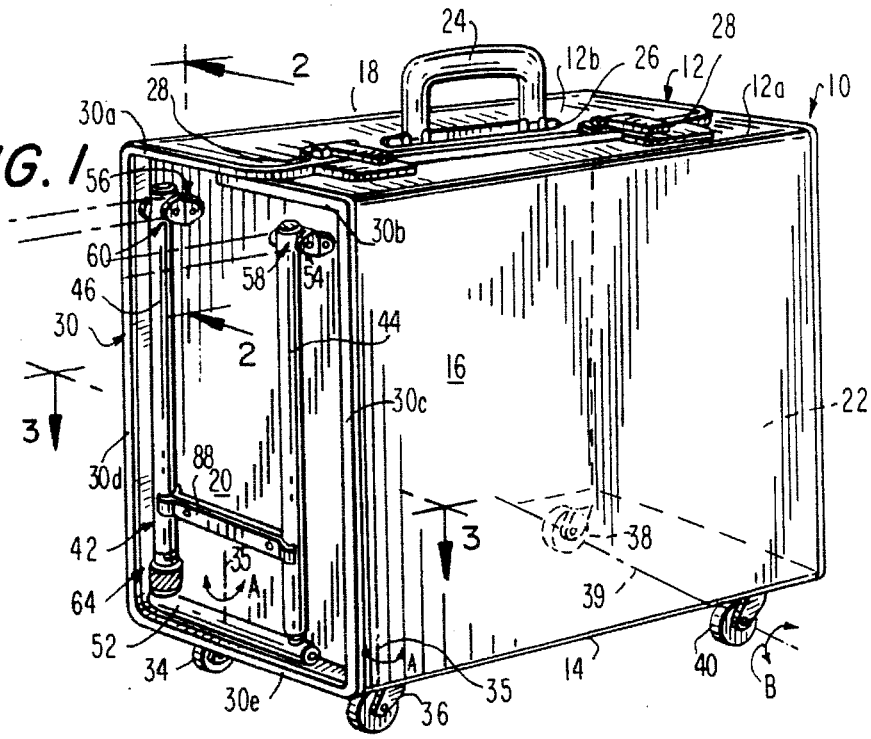
FIG. 1 is a perspective view of a mobile carrying case in accordance with this invention, showing a handle assembly in a stowed position.

Referring now to the drawings, reference numeral 10 in FIG. 1 generally identifies a mobile carrying case including a container having a top wall 12, a bottom wall 14, a pair of side walls 16, 18, and a pair of end walls 20, 22 bounding an interior in which objects to be carried are placed. All of the container walls are generally planar and rectangular in outline, preferably constituted of a natural material such as leather, or a synthetic material such as vinyl or analogous plastic material. The walls may be single-ply or multi-ply, and are capable of being stitched and/or glued together. Heavy-duty, rigid backing sheets, such as cardboard or plastic, may be used for reinforcement.

As shown in FIG. 1, the top and bottom walls 12, 14 are spaced apart in mutual parallelism along a first vertical direction. The side walls 16, 18 are spaced apart in mutual parallelism along a second width direction orthogonal to the first direction. The end walls 20, 22 are spaced apart in mutual parallelism along a third longitudinal direction orthogonal to both the first and second directions.

The top wall 12 includes a first flap 12*a* and a second flap 12*b* hinged on side walls 16, 18, respectively, and pivotable to an open state to enable access to the case interior or, as shown, pivotable to a closed state in which the flaps 12*a*, 12*b* at least partially overlie each other to deny access to the case interior. A carrying handle 24 on flap 12*b* extends through a cut-out 26 formed through the flap 12*a* in the closed state to enable a user to manually carry the case. Conventional combination locks 28 are also mounted on the flaps 12*a*, 12*b* to lock the flaps in the closed state.

Figure 3:
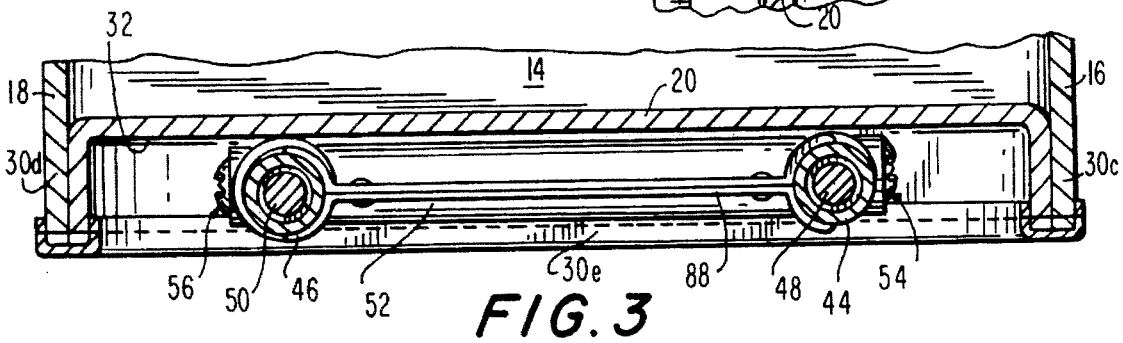
FIG. 3 is a broken-away, sectional view taken on line 3—3 of FIG. 1.

The top flaps 12*a*, 12*b* have outer peripheral end edges 30*a*, 30*b*, respectively. The side walls 16, 18 have outer peripheral end edges 30*c*, 30*d*, respectively. The bottom wall 14 has an outer peripheral end edge 30*e*. All of these end edges together constitute a continuous end flange 30 which, together with the end wall 20, bound an end cavity 32 (see FIG. 3) at each end of the case. Thus, as shown in FIG. 3, the end walls 20, 22 are located inwardly of the case.

As described so far, the container is conventional and is known in the luggage industry as a "catalog" case. In accordance with this invention, the catalog case is converted to a mobile carrying case by attaching various components to the exterior of the container. Thus, a pair of swivel wheels 34, 36 is mounted at front corner regions of the bottom wall 14 adjacent the end wall 20 for swiveling about independent vertical axes 35 in the directions shown by the double-headed arrows A. Another pair of wheels 38, 40 is mounted at rear corner regions of the bottom wall adjacent the end wall 22 for rolling movement about a common horizontal fixed axis 39.

A steering handle assembly 42 is exteriorly mounted on one of the end walls, e.g., end wall 20, and is movable between a stowed position (see FIG. 1) in which the assembly 42 is essentially contained in end cavity 32, and a plurality of steering positions (see FIG. 4) in each of which the assembly 42 extends outwardly of the end cavity 32. The assembly 42 includes a pair of elongated, cylindrical, hollow storage tubes 44, 46; a pair of elongated, cylindrical rods 48, 50 mounted in the tubes for telescoping movement lengthwise thereof between a retracted condition (see FIG. 1 ) and an extended condition (see FIG. 4); and a steering handle 52 connected to, and spanning a distance between, the rods 48, 50 for joint movement therewith.

Figure 2:
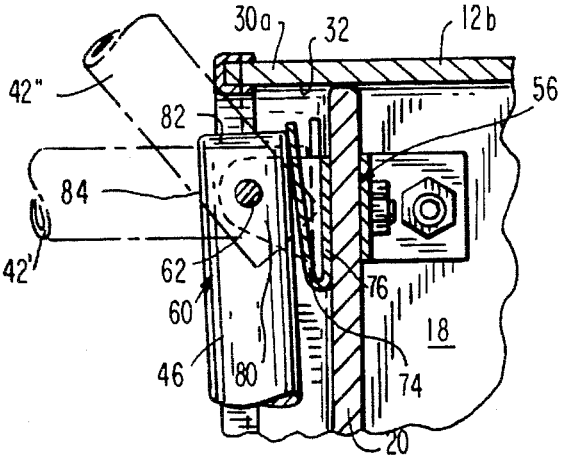
FIG. 2 is a broken-away, sectional view taken on line 2—2 of FIG. 1, showing additional positions of the handle assembly in phantom lines.

The tubes 44, 46 are pivotally mounted on the end wall 20 by a pair of brackets 54, 56. Each bracket has a pair of spaced-apart projections between which inner end regions 58, 60 of the tubes are respectively mounted for swinging movement about co-linear pivot shafts 62 extending along a common axis. FIGS. 1 and 2 show, in solid lines, the stowed position of the handle assembly 42 in which the rods are fully retracted within the tubes, thereby positioning the assembly 42 essentially within the end cavity 32. In this stowed position, a user can grip the handle 24, lift the case and carry it to any destination.

For heavier loads, the user can move the handle assembly 42 to either the first steering position shown by phantom lines 42' depicted in FIG. 2 in which the assembly 42 extends at a generally right angle relative to the end wall 20, or to the second steering position shown by phantom lines 42" depicted in FIG. 2 (or in solid lines in FIG. 4) in which the handle assembly 42 extends at a generally obtuse angle relative to the end wall 20. In either steering position, the rods 48, 50 may, if desired, be extended from their retracted condition. Again, see, for example, arrow C in FIG. 4. The steering handle 52 can thus be positioned at a variable height relative to the ground and at a variable longitudinal distance relative to the end wall 20.

As best shown in FIGS. 5 and 6, a lock 64 is operative to lock the steering handle 52 at a distance selected by the user. A manually-turnable element 66 having an exterior roughened surface, for example, by knurling, is threadably mounted onto an upper threaded region of one of the tubes, e.g., tube 46. A first locking member 68 surrounds the rod 50 and has a wedge-shaped annular head 70. A second locking member 72 also surrounds the rod 50 and overlies the head 70. By turning the element 66, the locking member 72 is pressed tightly into engagement with the head 70 which, in turn, is pressed tightly against the rod 50, thereby fixing the position of the rod in the tube and, in turn, fixing the position of the steering handle 52.

As best shown in FIG. 2, a leaf spring, preferably constituted of a resilient metal material, is employed to hold the handle assembly 42 in a selected one of its positions. The leaf spring has generally planar arms 74, 76 which cooperate with the inner end region 60 of the tube 46. Spring arm 76 is anchored by the bracket 56 to, and lies flat against, the end wall 20. The opposite spring arm 74 is cantilevered and is constantly biased against various exterior abutment surfaces on the inner end region 60 of the tube 46. Thus, the tubular end region 60 has a first abutment surface 80 engaged with the cantilever arm 74 which, as shown in solid lines in FIG. 2, pushes the abutment surface 80 counterclockwise about shaft 62 to bias the handle assembly to the stowed position.

The inner tubular end region 60 also has a second abutment surface 82 which is essentially orthogonal to the first abutment surface 80. When the handle assembly is positioned in the first steering position 42', the cantilever spring ann 74 engages the second abutment surface 82 and pushes against the tube 46 in an outward direction lengthwise thereof, thereby biasing the handle assembly 42 to remain in the first steering position.

The inner tubular end region 60 further has a third abutment surface 84 which is essentially orthogonal to the second abutment surface 82 and generally parallel to the first abutment surface 80. When the handle assembly is positioned in the second steering position 42", the cantilever spring arm 74 engages the third abutment surface 84 and pushes the same clockwise about shaft 62 to bias the handle assembly 42 to the second steering position.

The steering handle 52 may have a rubber, leather or analogous covering to provide a cushioned, better grip to aid in pulling, pushing or otherwise steering the case 10 when it is being wheeled about. In use as a rolling case, the steering handle 52 is gripped, and the handle assembly 42 is moved to one of the steering positions. The leaf spring ensures that the handle assembly will stay in the selected steering position. Thereupon, the lock 64 is unlocked, and the steering handle 52 is extended to a desired distance relative to the end wall, whereupon the lock 64 is again locked to fix the handle at said distance. Pulling, pushing or otherwise steering the handle 52 enables the case to be rolled along the ground.

In a modified construction, an anti-sway bar 88 is connected across the storage tubes 44, 46 in order to ensure that the tubes move in unison.

It will be understood that each of the elements described above, or two or more together, also may find a useful application in other types of constructions differing from the types described above.

While the invention has been illustrated and described as embodied in a mobile carrying case, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A mobile carrying case, comprising:

a) a container including top, bottom and side walls having peripheral end flanges, and end walls bounding end cavities with the peripheral end flanges, all of said walls bounding an interior;

b) a carrying handle on the top wall;

c) a plurality of wheels on the bottom wall;

d) a steering handle assembly exteriorly mounted on one of the end walls for movement between a stowed position in which the assembly is essentially contained within one of the end cavities, and a plurality of steering positions in each of which the assembly extends outwardly of said one end cavity, said steering handle assembly including a pair of storage tubes mounted on said one end wall for pivoting movement among said positions, and one of said tubes having three exterior abutment surfaces; and e) means for holding the assembly in each of said positions, said holding means including a spring mounted between said one tube and said one end wall for holding said one tube in a selected one of said positions, said spring engaging one of the abutment surfaces the stowed position, another of the abutment surfaces in a first steering position, and still another of the abutment surfaces in a second steering position.

2. The case according to claim 1, wherein the top wall includes a pair of flaps movable between open and closed states in which access to the interior is permitted and denied, respectively.

3. The case according to claim 1, wherein the bottom wall has four corner regions; and wherein there are four wheels, one at each corner region; and wherein two of the wheels at the corner regions adjacent the assembly are mounted on the bottom wall for swiveling movement; and wherein the remaining two of the wheels at the two remaining corner regions remote from the assembly are mounted on the bottom wall for rolling movement about a fixed axis.

4. The case according to claim 1, wherein all of the walls are generally planar; and wherein the top and bottom walls are spaced apart in mutual parallelism along a first direction, and wherein the side walls are spaced apart in mutual parallelism along a second direction generally perpendicular to the first direction; and wherein the end walls are spaced apart in mutual parallelism along a third direction generally perpendicular to the first and second directions.

5. The case according to claim 1, wherein the steering handle assembly includes a pair of elongated rods mounted for telescoping movement along the tubes, and a steering handle connected to the rods for joint movement therewith.

6. The case according to claim 5; and further comprising anti-sway means extending between the tubes.

7. The case according to claim 5; and further comprising means for adjustably locking the steering handle at a selected distance away from said one end wall, including a manually turnable element on one of the storage tubes for lockingly engaging the rod mounted within said one storage tube.

8. The case according to claim 1, wherein the tube extends at a generally right angle relative to said one end wall in the first steering position, and at an obtuse angle relative to said one end wall in the second steering position.

* * * * *